United States Patent [19]

Turbeville

[11] Patent Number: 5,020,560

[45] Date of Patent: Jun. 4, 1991

[54] WALKER HAVING WHEELS AND BRAKES

[76] Inventor: Rob Turbeville, 207 Dunbridge Dr., Palm Harbor, Fla. 34684

[21] Appl. No.: 568,995

[22] Filed: Aug. 17, 1990

[51] Int. Cl.[5] ..... A61H 3/00

[52] U.S. Cl. ..... 135/67; 280/282; 280/42; 280/304.1; 297/5; 188/75; 188/167

[58] Field of Search ..... 135/67, 65; 280/282, 280/287, 304.1, 42, 250.1; 297/5, DIG. 4; 188/166, 167, 19, 20, 74, 75

[56] References Cited

U.S. PATENT DOCUMENTS

| | | | |
|---|---|---|---|
| 2,777,546 | 1/1957 | Kelley | 188/75 X |
| 3,337,230 | 8/1967 | Golding | 297/5 X |
| 3,999,778 | 12/1976 | Markiel | 297/5 X |
| 4,461,471 | 7/1984 | Braston | 272/70.3 |
| 4,700,730 | 10/1987 | Samuelson et al. | 135/67 |
| 4,813,664 | 3/1989 | Vroulis | 272/70.3 |
| 4,867,438 | 9/1989 | Steckert et al. | 135/67 X |

FOREIGN PATENT DOCUMENTS

| | | | |
|---|---|---|---|
| 345114 | 4/1960 | Switzerland | 135/67 |

*Primary Examiner*—David A. Scherbel
*Assistant Examiner*—Lan Mai
*Attorney, Agent, or Firm*—Stanley M. Miller

[57] ABSTRACT

A walker that has wheels to facilitate its movement when it is not being relied upon as a primary means of support and that has brakes to hold said wheels against rotation when it is. The wheels are arranged in a tricycle configuration and brakes are associated with the two rear wheels. A pair of brake pads flank each wheel and are held into braking relation to each wheel by a pair of spring members, there being one spring for each brake, when little or no weight is applied to the walker by the user. The springs are compressed and the wheels are free to rotate when the weight of the user is applied to the walker. The user's forearms rest in padded armrests and hand grips are provided forwardly of those arm rests. The walker is adjustable in height and is foldable when not in use.

20 Claims, 2 Drawing Sheets

WALKER HAVING WHEELS AND BRAKES

BACKGROUND OF THE INVENTION

1. Field of the Invention

This invention relates, generally, to medical appliances. More particularly, it relates to a walker equipped with wheels and a braking means that prevents the wheels from rotating when the user of the walker is using the walker for support purposes.

2. Description of the Prior Art

In the field of walking aid devices for the physically handicapped or infirmed, such devices known as walkers are many and diverse. Some of these walkers, ranging from canes to three legged and four legged devices, are usually utilized by gripping the handle or handles, moving the walker or cane forward and then catching up with progressive steps. Some walkers have wheels at the bottom which enable the user to shove the device forward rather than lifting and progressing in a halting or stop and go motion. With these wheels, the user is able to walk in a relatively normal fashion using the walker as a support as he ambulates. Some of these walkers are four legged with two wheels on the forward legs and rubber feet at the rear. The forward wheels may have brakes built into them so that when the user applies body weight to the walker, it becomes stabilized and does not roll as he catches up to the walker. However, this type of walker relies on the user's applying downward pressure to the walker through the entire length of his arms, through his wrists and to his hands and is generally used in a somewhat bent forward manner as he walks. Some users are unable to utilize such a walker due to weakness in the arms, forearms, elbows, wrists or hands in gripping the device.

These devices are admirably suited to fulfill their intended purpose. However, in most cases, either the wheels are not brakeable, or if provided with brakes, are actuated by squeezable handles applying pressure to the perimeter of the rear wheels when it is desired to brake the device.

SUMMARY OF THE INVENTION

The present invention differs in that no manually actuated brakes are incorporated in the device. The device is in a normally braked position until the user applies pressure through his forearms to the arm rests, thereby releasing the brakes and allowing him to progress forward. With a forward pivotal caster, the device can be aimed in the direction that the user wishes to go. There are also a pair of angled handle grips forward of the arm rests which are adjustably angled for the user to grip while walking.

Thus, a person who may be severely handicapped by arthritis or other painful infirmities may utilize the present invention without manipulatory operations in order to utilize the invention. All the user has to do is apply slight downward pressure through his forearms and elbows through the device to proceed forward.

BRIEF DESCRIPTION OF THE DRAWINGS

This and many other advantages will be realized as we examine the figures in which like characters refer to like parts of the invention and in which.

DETAILED DESCRIPTION OF THE PREFERRED EMBODIMENT

Figure 3:
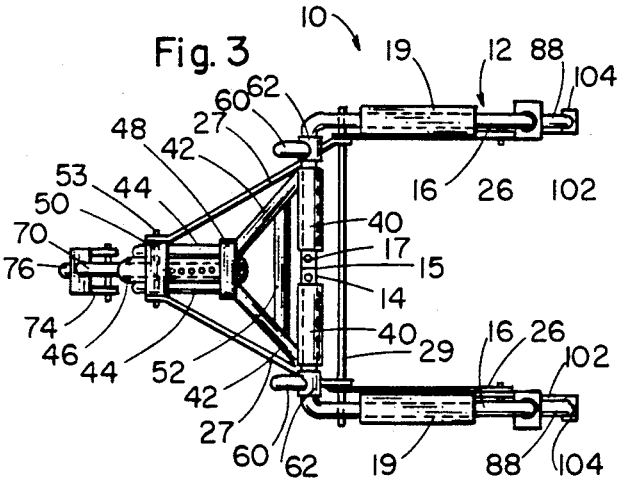
FIG. 3 is a top plan view of the invention.
Figure 2:
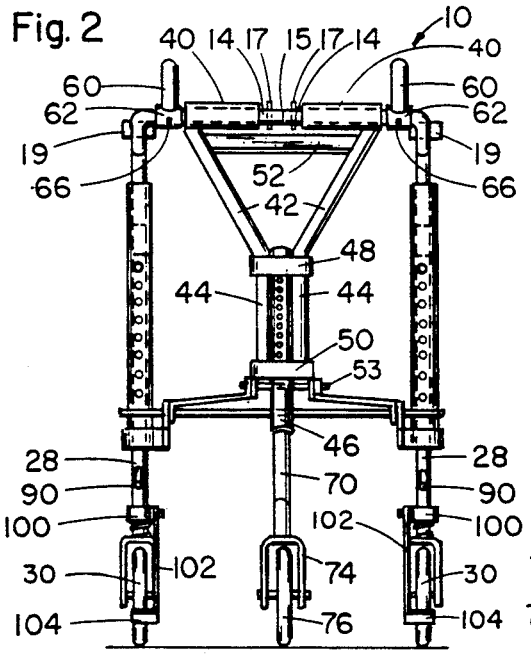
FIG. 2 is a front elevational view of the invention.
Figure 1:
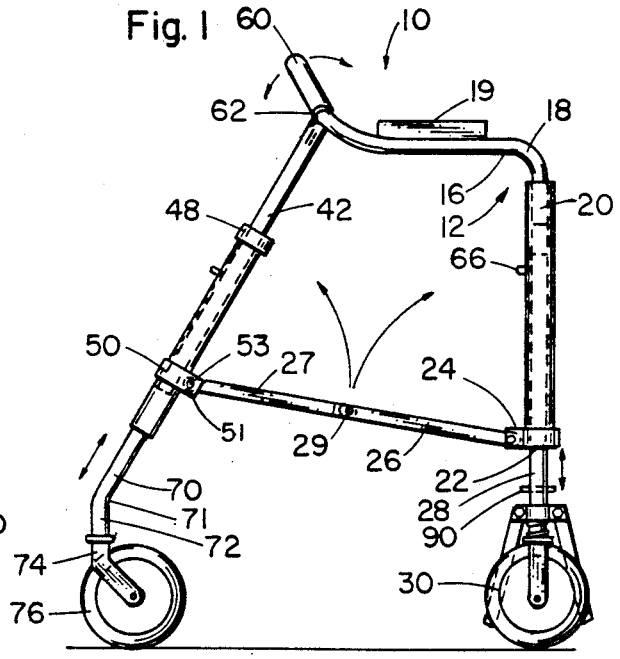
FIG. 1 is a side elevational view of the invention.

Referring now specifically to the Figures in which like characters refer to like parts, refer specifically now to FIGS. 1, 2 and 3 in which the invention is referred to by the numeral 10 with arrow. The device consists of a main rear frame 12 with arrow which channels an upper horizontally disposed tubular member 14 which then extends into a pair of rearwardly disposed arms 16 parallel to the terrain and thus forming a generally U-shaped configuration when viewed from the top. The arm 16 then bends downwardly in a vertical configuration 18 to form the rear legs of the invention. Attached to the portions 18 is a larger concentrically fitted tube 20 which proceeds downwardly and terminates at 22 with a clamped on collar 24 for receiving the adjustable arms 26 of the collapsible feature of the device.

Proceeding downwardly from the tube 20 is another tube 28 which fits concentrically within the tube 20 and which supports the rear wheels 30 along with the braking mechanism which will be hereinafter described.

Turning now to the cross member 14, there are a pair of concentrically fitted tubes 40 which have diagonally mounted support members 42 which then are bent downwardly as at 44 and are clamped to a central tube 46 by mean clamps 48 and 50. Near the top of the pair of tubes 42 is a connecting member which may be flat bar or tubed, the connecting member being 52 which is a generally triangular form to the upper portion of the forward wheel support as can be best seen in FIG. 2. This cross member 52 may be welded to the members 42 as well as the members 42 being welded to the members 40.

Also, in FIG. 2, it will be noted that the member 14 is split in two so that the components that fit over the member 14 can be slipped on in the process of fabrication and construction. The members 14 may be joined as at 15 with a dowel within itself being pinned or bolted as at 17. Thus, it can be seen that the pairs of members forming the rear legs and arm rests which are pre-bent may be joined together as indicated. However, theY may be dowelled or welded or plug welded for permanent connection to each other. This would be at the option of the manufacturer and is not that pertinent to the inventive concept itself.

Upon the members 14 are the rotatably adjustable handles 60 which are welded to a concentrically fitted tube 62 and which are provided with a plurality of holes 64 through which a detent 66 may be urged through a spring 68 within the tube 14. This is a well-known means of providing adjustability within two concentrically mounted tubes. This is a U-shaped lead spring 68 with a detent 66 which protrudes through a holding tube, in this case 14, and a rotatable or slidable tube which in this case is 62. Thus, it can be seen that the handle 60 may be rotated to a number of various positions or retracted completely when the device is collapsed.

To meld the handle 60 with their attendant tubes 62 upon the portion 14 of the invention, these must be slidably placed upon the tubing 14 and then the tubing 14 is slidably inserted into the members 40 before they can be joined as previously described.

Figure 4:
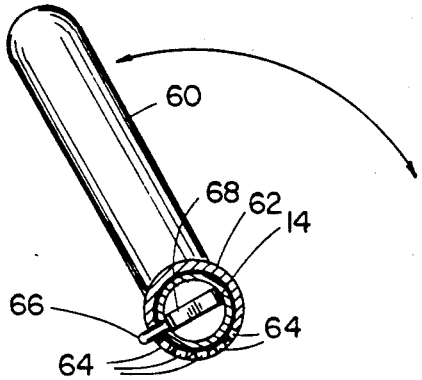
FIG. 4 is an enlarged detail of the rotatably adjustable hand grips of the invention.

Referring to the forward wheel support, there is a bent tube 70 which is inserted into the fork tube 46 which has the detent arrangement described in FIG. 4 for the handle 60. This detent arrangement provides telescopic adjustability to the forward wheel support 70. As can best be seen in FIG. 1, the forward wheel support 70 is bent as at 71 to form a vertical portion 72 which receives an insertable pin, not shown, which is part of the caster forks 74 to support the forward wheel 76. This concept is well known to those practiced in the art.

It will be noted in the side view of FIG. 1 that the lower bracket 50 has ears 51 through which a pivoting axle 53 passes and which pivotally supports one end of a swingable bracket 27 which connects with bracket 26 through a long axle 29 providing a central pivot point for the foldable braces or brackets 26 and 27.

As can best be seen in FIGS. 1 and 3, there are padded arm rests 19 attached to the upper portion of the horizontal member 16 of the rear unit 12. It can also be seen in FIG. 2 that there are detents in the rear leg members 20 and detent holes 64 along the forward portion of the tubes 20 providing a plurality of adjustments in height of the walker.

Figure 5:
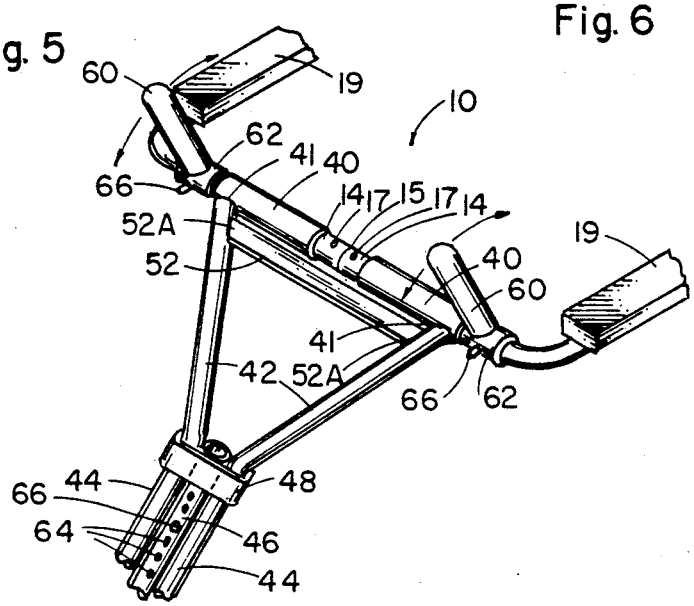
FIG. 5 is a perspective view of the upper portion of the invention showing the arm rests, the hand grips and the triangulated upper of the forward wheel support.

Referring now to FIG. 5, the perspective of the upper portion of the walker, there is provided a better view of the arrangement of the horizontal member 14 as it is attached at 15 by means of bolts or rivets 17. It also provides a better view of the rotatably adjustable handles 60 as mounted on the tube 62 with the detents 66 providing the adjustment. Also, it better discloses the arrangement of the pair of V-shaped members or the V-shaped forming members 42 as they are weldably attached to the members 40 as at 41 and the horizontal connecting member 52 which is welded to the members 42 at 53. This view also discloses the collar or bracket 48 as it surrounds the central member 46 and the lower legs 44 of the members 42. Also visible in this view are the detent holes 64 and the detent 66 of this telescopic leg arrangement.

Figure 6:
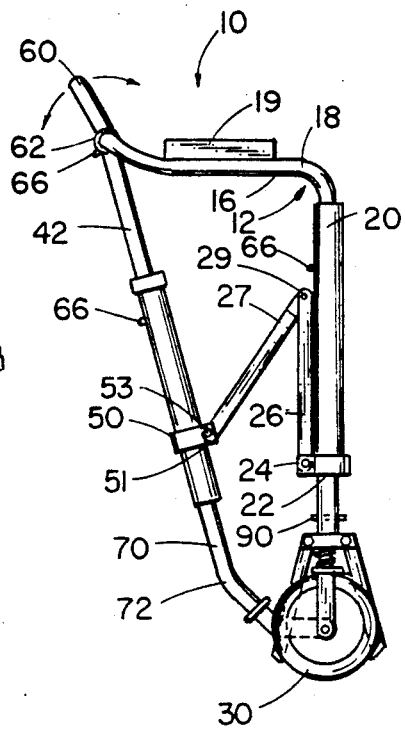
FIG. 6 is a side elevational view of the device in its collapsed configuration for transporting.

Referring now to FIG. 6, this is a side elevational view of the walker in its collapsed configuration for portability. As can be seen in this view, the arm or link 26 has been folded up against the tubular member 20 and the axle 29 has been brought to bear against the tubular member 20. At the same time, the swingable arm 27 has swung upward and with the axle 29 pinned against or brought to bear against the tubing 20, this provides the final collapsed position of this unit. The pivot point for this collapsibility is at the cross member 14 as the outer tubing members 40 pivot about the cross member 14. The handles 60 may be rotatably adjusted around to thereby shorten the overall length of the walker when it is in the collapsed position as shown in FIG. 6.

Figure 7:
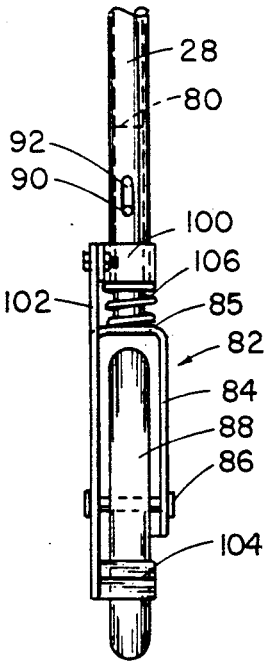
FIG. 7 is a front view of an enlarged detail of the braking device of the rear wheel.
Figure 8:
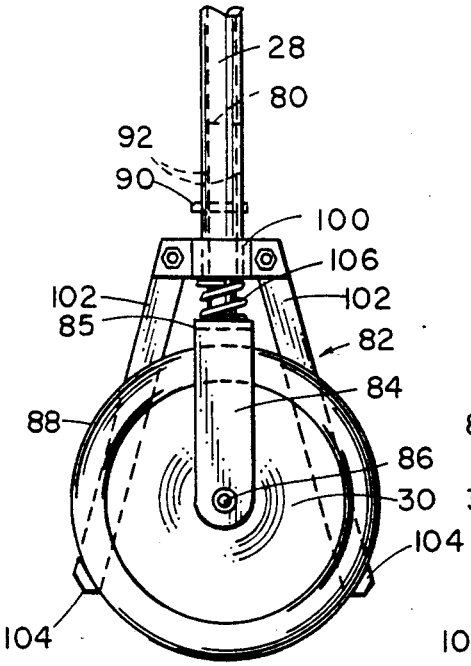
FIG. 8 is a side elevational view of the same braking device, FIGS. 7 and 8 being in their normal configuration.
Figure 9:
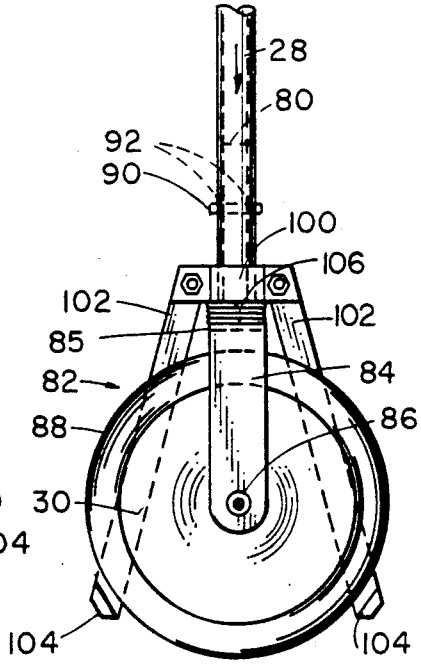
FIG. 9 is a side elevational view similar to FIG. 8 but with the downward pressure applied to the rearward legs and wheels thereby releasing the brakes from the wheel.

Referring now to FIGS. 7, 8 and 9, these figures disclose the mechanical arrangement which provides the automatic braking for this walker device. Referring specifically to FIGS. 7, 8 and 9, there is the lower support tubing 28 which receives the vertical pintle 80 of the caster arrangement 82 with arrow. This caster arrangement consists of the forks 84, axle 86 and the actual wheel or caster 88. The forks 84, of course, are permanently attached to the pintle 80 which is slidably mounted within the leg 28. Running fore and aft through the pintle 80 is a guide pin 90 which may be what is commonly known as a spring pin inserted into a hole in the pintle 80. There are a pair of slots fore and aft 92 in the tube 28. There is a bracket or a collar bracket 100 which is clamped to the bottom end of the tube 28. This bracket 100 is bolted to a generally inverted V-shaped member 102, the lower extremities of which have a brake pad 104 attached thereto. This brake pad may be serrated or knurled on its inner surfaces to better grip the rubber tire of the caster wheel 88. This arrangement with its collar and inverted V-shaped legs is adjustably attached to the lower end of the tube 28. This provides an adjustment which will be hereinafter described.

Between the top 85 of the fork 84 and the bottom of the collar 100 is a compression coil spring 106 which urges the forks 84 away from the collar or bracket 100. Thus, it can be seen that when the walker is in its standing position without any weight applied to the top of it, the wheels are effectively braked preventing the walker from moving, stabilizing the walker. However, when a person exerts downward pressure on the arm pads or arm rests 19, the compression spring is compressed and the inverted V-shaped legs 102 with their brake pads 104 are depressed downwardly away from the surface of the caster wheel 88 as best seen in FIG. 9. Therefore, when the user exerts pressure on the arm rests 19 and is gripping the handle grips 60, he can effortlessly walk with this walker in any direction with a minimal amount of discomfort to the lower extremities whether he has pain in the ankles, toes, balls of his feet, knees, thighs, or whatever, this device enables him to rest his upper torso on the arm rests, diminishing the pressure on the lower extremities while walking about with this walker. When he stops walking and wishes to have the walker in a stabilized position, he needs merely to remove the weight from the arm rests.

Regarding the adjustable feature previously mentioned, it can be clearly understood that by increasing the distance between the bracket 100 and the top of the fork 85, relocating this bracket in a more distant position, it diminishes the amount of downward pressure required to release the brakes. However, by closing up the distance between the bracket 100 and the top of the forks 85, the compression of the spring is increased thereby requiring more pressure to release the brakes. This adjustable feature can be used to accommodate the user's ability to function with this walker.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanYing drawings shall be interpreted as illustrative and not in a limiting sense.

It is also intended to be understood that the following claims are intended to cover all of the generic and specific features of the invention herein described, and all statements of the scope of the invention which, as a matter of language, might be said to fall therebetween.

Now that the invention has been described,

What is claimed is:

1. A walker, comprising:

a main rear frame, said main rear frame having a horizontally disposed tubular member, a pair of rearwardly extending arms integral to opposite ends thereof, and a pair of downwardly extending rear leg members, a rotatably mounted rear wheel disposed at the lower end of each of said rear leg members, a brake member associated with each of said rear wheels, means adapting said rear wheel brake members to hold said rear wheels against rotation when a user of said walker is placing weight below a predetermined threshhold on said walker, thereby indicating that said user is supporting that user's body weight by means other than said walker and relying upon the walker during such time as a non-rolling support means, a forward wheel support having an upper end secured to said horizontally disposed tubular member of said main rear frame and having a rotatably xounted forward wheel disposed at a lower end thereof.

2. The walker of claim 1, wherein said means adapting said rear wheel brakes includes a collar bracket secured to each rear leg member in vertically spaced relation above its associated rear wheel, each of said rear wheels being caster wheels positioned intermediate forks of said caster wheels, a pair of rigid members depending from said forks, a brake pad secured to a lowermost end of each of said depending rexbers, and a bias means positioned between said forks and said collar, said bias means having a bias sufficient to lift said collar and hence said depending members and brake pads into braking relation with their associated rear wheel members when there is substantialy no weight on said frame, and said bias means being insufficient to maintain said brake pads in said braking relation when a downwardly directed force above a predetermined threshhold is exerted upon said frame.

3. The walker of claim 2, further comprising a pair of longitudinally extending arm rest members, configured and dimensioned to cradle human forearms, being positioned atop each of said arms so that a person using said walker may rest said person's forearms thereatop, thereby enabling said person to support said person's weight at least in part along said forearms, thereby relieving the need to support weight on said person's hands and wrists.

4. The walker of claim 3, wherein said rear wheels are laterally spaced apart from one another and said forward wheel is positioned forwardly and equidistantly therefrom to thereby provide a tricycle wheel arrangement to enhance the stability of the walker.

5. The walker of claim 4, further comprising a pair of foldable link arms disposed in interconnecting relation between said forward wheel support and said rear leg memters so that said walker is collapsible when said foldable link arms are folded.

6. The walker of claim 5, wherein each of said rear leg members is of telescopic construction so that the walker can be adjusted to accommodate individuals of differing heights.

7. The walker of claim 6, wherein said forward wheel support is of telescopic construction so that the walker can be adjusted to accommodate individuals of differing heights.

8. The walker of claim 2, further comprising a pair of hand grips positioned in laterally spaced relation to one another at opposite ends of said main rear frame horizontally disposed tubular member, said hand grips being positioned forwardly of said arm rests so that the individual using said walker may grip said hand grips while resting said individual's forearms in said arm rests during use of said wlaker.

9. The walker of claim 8, further comprising means for adjusting the angular orientation of said hand grips relative to said horizontally disposed tubular member to accommodate the hands of persons having forearms of differing lengths.

10. A walker, comprising:

a frame having a pair of laterally spaced rear leg members and a rotatably mounted rear wheel disposed at the lower end of each leg member, said frame further having a forward wheel support and a forward wheel mounted at a lowermost end thereof in rotatable relation to a support surface, and braking means associated with said rear wheels, said braking means being disengaged with said rear wheels when a person is at least partially supporting that person's weight on said frame so that said rear wheels are free to rotate at that time, and said braking means being engaged and stopping said rear wheels from rotating when the weight applied to said rear wheels is below a predetermined threshhold.

11. The walker of claim 10, wherein said frame includes a pair of horizontally disposed, longitudinally extending arm members and a padded arm rest overlying both of said arm members, said arm rest adapted to support a human forearm thereatop.

12. The walker of claim 11, wherein said braking means includes bias means for engaging said braking means when weight below said predetermined threshhold is applied to said frame.

13. The walker of claim 12, wherein said rear leg members and said forward wheel support are of telescopic construction to facilitate adjustment of the height of said walker.

14. The walker of claim 13, further comprising an adjustably positionable hand grip associated with each arm rest, forwardly thereof.

15. The walker of claim 10, further comprising reans for folding said walker, said means for folding including a foldable link member extending between said forward wheel support and said rear leg members.

16. The walker of claim 15, wherein the forward and rear wheel members are arranged in a tricycle configuration.

17. A walker having a forward wheel rotatably xounted to a forward wheel support, a pair of laterally spaced apart rear wheels rotatably mounted to respective members of a pair of rear leg members, said forward and rear wheels being disposed in a tricycle configuration, a braking means associated with each of said rear wheels, said braking means being activated only when the walker is supporting weight below a predetermined threshhold, and said braking means including a bias means that lifts said braking means into braking engagement with said rear wheels when said weight is below said predetermined threshhold.

18. The walker of claim 17, wherein said walker is adapted to support a user's weight along said user's forearms, said walker including padded forearm rests along a horizontal part thereof.

19. The walker of claim 18, further comprising a pair of adjustably mounted hand grips mounted forwardly of said forearm rests.

20. The walker of claim 19, wherein said forward wheel support and rear leg members are telescopically adjustable and further comprising means for folding said forward wheel support and said rear leg members toward one another to thereby collapse said frame into a smaller space for storage purposes.

* * * * *